United States Patent [19]

Kamiyama et al.

[11] 4,373,800

[5] Feb. 15, 1983

[54] WET TYPE ELECTROPHOTOGRAPHIC COPYING MACHINE

[75] Inventors: Shin-ichi Kamiyama, Yokohama; Kiyoshi Ohshima, Kawasaki; Manabu Mochizuki, Yokohama; Kazuyuki Kato, Tokyo; Takeshi Saito, Yokohama, all of Japan

[73] Assignee: Ricoh Company, Ltd., Tokyo, Japan

[21] Appl. No.: 207,999

[22] Filed: Nov. 18, 1980

[30] Foreign Application Priority Data

Dec. 3, 1979 [JP] Japan ..... 54-155562
Mar. 24, 1980 [JP] Japan ..... 55-36221

[51] Int. Cl.[3] ..... G03G 15/10

[52] U.S. Cl. ..... 355/10; 355/15; 118/652

[58] Field of Search ..... 355/10, 14 E, 14 D, 355/15; 430/117, 118; 118/652, 659

[56] References Cited

U.S. PATENT DOCUMENTS 3,892,481 7/1975 Schaefer et al. ..... 355/10
4,021,111 5/1977 Kuroishi et al. ..... 355/10
4,077,711 3/1978 Akamatsu ..... 355/10
4,154,522 5/1979 Ikesue ..... 355/10
4,215,930 8/1980 Miyakawa et al. ..... 355/14 E X

*Primary Examiner*—G. Z. Rubinson
*Assistant Examiner*—Keith E. George
*Attorney, Agent, or Firm*—Oblon, Fisher, Spivak, McClelland & Maier

[57] ABSTRACT

A wet type electrophotographic copying machine of the type capable of performing one copy making process during substantially two revolutions of a photoconductor, which is provided with means for forming a liquid developer deposition portion by charging, exposure and development, on the downstream side of an image formation area on the photoconductor, the liquid developer deposition portion capable of substantially narrowing the gap between the photoconductor and a squeegee roller, whereby the squeezing of excess developer from the surface of the photoconductor can be performed at the squeezing initiation point on the photoconductor, thus attaining a sharp squeezing effect, and the adhesion of the excess liquid developer to an image transfer material can be prevented.

8 Claims, 11 Drawing Figures

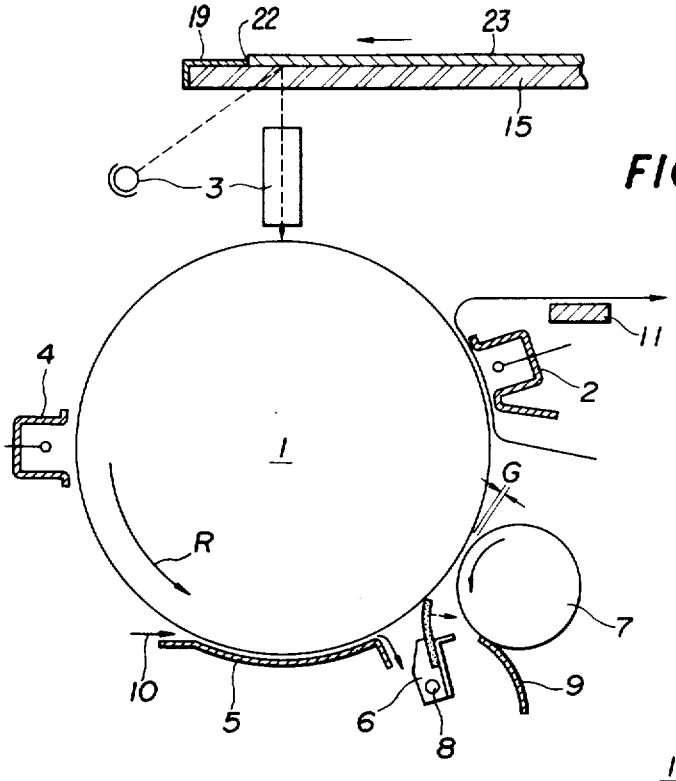
FIG. 4
FIG. 6
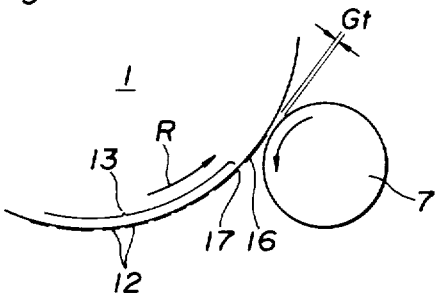
FIG. 5
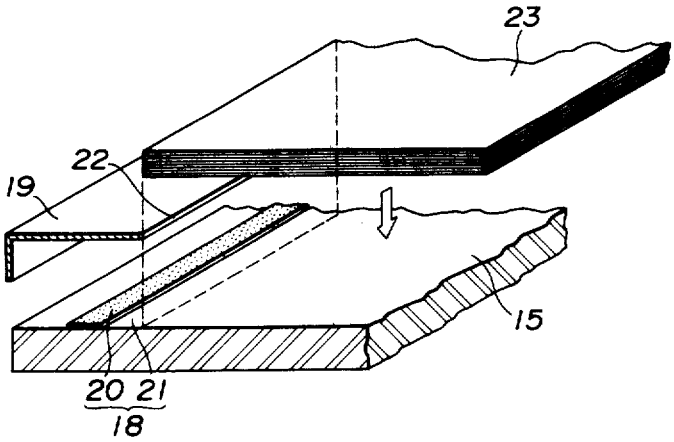

WET TYPE ELECTROPHOTOGRAPHIC COPYING MACHINE

BACKGROUND OF THE INVENTION

The present invention relates to a wet type electrophotographic copying machine and more particularly to a wet type electrophotographic copying machine provided with a mechanism capable of making a copy during substantially two revolutions of a photoconductor.

Referring to FIG. 1, a conventional electrophotographic copying machine of the type described will now be explained. In the figure, around a drum-shaped photoconductor (hereinafter referred to as the photoconductor drum), there are arranged in order (in the direction indicated by the arrow R) a charger 2 for charging and image transfer, an exposure apparatus 3, a quenching charger 4, a development section 5, a cleaning member 6 and a squeegee roller 7. The cleaning member 6 is rotatable about a shaft 8 and, by the rotation thereof, a top edge portion of the cleaning member 6 can be brought into contact with the surface of the photoconductor drum 1 is detached therefrom. The squeegee roller 7 is disposed in close proximity to the surface of the photoconductor drum 1 with a small gap G and is rotatable in the direction opposite the rotating direction (indicated by the arrow R) of the photoconductor drum 1. A squeegee blade 9 is in contact with the peripheral surface of the squeegee roller 7.

The operation of the copying machine will now be explained.

When the main switch (not shown) of the copying machine is turned on, the photoconductor drum 1 begins to rotate and a liquid developer pump (not shown) for supplying a liquid developer 10 to the development section 5 is actuated. During the first revolution of the photoconductor drum 1, the surface of the photoconductor drum 1 is uniformly charged by corona charges applied by the charger 2. An optical image of an original is projected onto the surface of the charged surface of the photoconductor drum 1 by the exposure apparatus 3 to form an electrostatic latent image on the surface of the photoconductor drum 1. The electrostatic latent image bearing surface of the photoconductor drum 1 passes over the deenergized quenching charger 4 and comes to the development section 5, so that the liquid developer 10 is deposited on the surface of the photoconductor drum 1 and the electrostatic latent image is developed to a visible image.

Just before the leading edge of the thus formed image on the photoconductor drum 1 comes to the cleaning member 6, the cleaning member 6 is disengaged from the surface of the photoconductor drum 1. The position on the surface of the photoconductor drum 1 from which the cleaning member 6 has been disengaged comes to the position of the squeegee roller 7, excess developer is removed from the surface of the photoconductor drum 1, and the developer removed from the surface of the photoconductor drum 1 is recovered into a developer tank through a squeegee blade 9.

The photoconductor drum 1 successively makes the second revolution and, at the same time, an image transfer sheet (not shown) is fed from a sheet feeding apparatus (not shown) between the photoconductor drum 1 and the charger 2, and the developer deposited on the surface of the photoconductor drum 1 is transferred to the transfer sheet. The transfer sheet is then subjected to image fixing by drying and discharged from the copying machine. After the image transfer, the photoconductor drum 1 is rotated and the surface of the photoconductor drum 1 passes under the exposure apparatus 3 from which no light is projected, and the developer remaining on the surface of the photoconductor drum 1 is removed by the cleaning member 6 which is brought back into contact with the surface of the photoconductor drum 1, so that one copying cycle is completed and the electrophotographic copying machine is ready for the next copying.

The advantages of a wet type of electrophotographic copying machine of the type in which one copy is made during two revolutions of a photoconductor drum, over an ordinary wet type electrophotographic machine of the type capable of making one copy during one revolution of a photoconductor drum, are as follows:

The first advantage is that, since the cleaning member 6 can be disposed near the development section 5, the liquid developer in the development section 5 can be used as the cleaning liquid for cleaning the surface of the photoconductor drum 1.

The second advantage is that, since the cleaning member 6 is disposed near the development section 5, it is easy to recover the liquid developer which has been used as the cleaning liquid.

The third advantage is that, since the charger 2 can serve as a corona charger for applying charges to the surface of the photoconductor 1 and as a charger for transferring the developed image from the surface of the photoconductor drum 1 to the transfer sheet, the number of the required devices can be reduced in comparison with the ordinary electrophotographic copying machine.

In the electrophotographic copying machine provided with the mechanism for making one copy during two revolutions of the photoconductor drum 1, the gap G between the photoconductor drum 1 and the squeegee roller 7 has a significant effect on the copying performance of the copying machine. Specifically, when the gap G is great, the squeezing of the liquid developer cannot be initiated properly. As a result, more developer tends to be deposited in the leading edge portion of the image formation area on the surface of the photoconductor drum 1 than in the remainder thereof. The amount of the developer deposited in the leading edge portion is such that it flows down along the surface of the photoconductor drum 1. Furthermore, when the leading edge portion of the photoconductor drum 1 comes near the charger 2 (which has been energized to apply charges to the surface of the photoconductor drum 1 for attaining a stable image transfer effect, before the image transfer sheet comes to the charger 2), the liquid developer is electrically attracted in the downstream direction with respect to the rotation of the photoconductor drum 1, so that the flow of the liquid developer along the surface of the photoconductor drum 1 is accelerated, and excess developer is deposited in the leading edge portion of the image transfer sheet.

In order to avoid such a problem, it is conceivable to lengthen the distance between the squeezing initiation position and the image formation area on the photoconductor drum 1, thereby avoiding the deposition of the liquid developer on the image transfer sheet even if the developer flows down as mentioned above. However, the size of the image formation area on the photoconductor drum 1 is determined by the maximum copying size of the copying machine. Therefore, it is required that the size of the photoconductor drum 1 be increased in order to lengthen the distance between the squeezing initiation position and the image formation area on the photoconductor drum 1, with the result that the copying machine has to be increased in size. Furthermore, in order to attain a predetermined copying speed, the peripheral speed of the photoconductor drum 1 has to be increased corresponding to the increased length between the squeezing initiation position and the image formation area on the photoconductor drum 1.

On the other hand, if the gap G between the photoconductor drum 1 and the squeegee roller 7 is decreased as much as possible, the squeezing of the developer can be done effectively even at the squeezing initiation position. However, the amount of the developer deposited on the photoconductor drum 1 is so decreased that the image density of the copy may be lowered. If the gap G between the photoconductor drum 1 and the squeegee roller 7 varies, it may occur that the photoconductor drum 1 comes into complete contact with the squeegee roller 7. Therefore, the positioning of the photoconductor drum 1 and the squeegee roller 7 has to be controlled most accurately, but it decreases the efficiency of the production of the copying machine and becomes costly.

SUMMARY OF THE INVENTION

It is therefore an object of the present invention to provide an improved wet type electrophotographic copying machine from which the shortcomings of the conventional electrophotographic copying machines have been successfully eliminated.

Another object of the present invention is to provide a wet type electrophotographic copying machine of the type described with a significantly improved copying performance, which is capable of preventing a recording material or image transfer sheet from being smeared by the developer even if the developer partly coagulates and adheres to an edge portion of a cleaning member for cleaning the surface of the photoconductor and accumulates thereon.

In order to attain the first-mentioned object, an embodiment of a wet type electrophotographic copying machine according to the present invention is characterized in that there is provided means for forming a liquid developer deposition portion on the surface of a photoconductor by charging and development in a portion on the downstream side of the image formation area in which an original image to be transferred to an image recording material is formed, in a wet type electrophotographic copying machine of the type capable of making one copy during substantially two revolutions of the photoconductor, provided with a development section for applying a liquid developer to the surface of a photoconductor which bears an electrostatic latent image, which development section is disposed in proximity to the peripheral surface of the photoconductor, extending in the direction of the movement of the photoconductor; a cleaning member which can be brought into contact with or detached from the surface of the photoconductor on which the electrostatic latent image can be formed; and an excess developer elimination member, such as a squeegee roller, for eliminating the excess developer from the surface of the photoconductor, which developer elimination member is disposed in proximity to the surface of the photoconductor with a small gap therebetween. Further, in this embodiment, the gap between the surface of the photoconductor and the excess developer elimination member is substantially narrowed by the liquid developer deposition portion, whereby the liquid developer is prevented from being deposited in quantity on the squeezing initiation position on the photoconductor.

The second mentioned object of the present invention is attained by further improving the wet type electrophotographic copying machine for achieving the first mentioned object.

The improved wet type electrophotographic copying machine is also of the type capable of forming one copy during substantially two revolutions of a photoconductor and there is provided means for forming a dark area by charging and development, which constitutes the liquid developer deposition portion for substantially narrowing the gap between the photoconductor and the excess developer elimination member, in a portion on the downstream side of the image formation area for forming an original image to be transferred to a recording material, with respect to the movement direction of the photoconductor, and a light area with less developer deposition which is disposed on the upstream side of the dark area with respect to the movement of the photoconductor. As mentioned above, by that means, the dark area and light area are formed on the downstream side of the image formation area on the photoconductor with respect to the movement direction of the photoconductor, whereby the adverse effects of the coagulated developer on the copy quality are eliminated.

BRIEF DESCRIPTION OF THE DRAWINGS

In the drawings,

FIG. 4 is a diagrammatical view of another embodiment of a wet type electrophotographic copying machine according to the present invention.

FIG. 5 is an enlarged perspective view of the main portions near the contact glass of the wet type electrophotographic copying machine in FIG. 4.

FIG. 6 and FIG. 8 are the diagrammatical views of the main portions of the wet type electrophotographic copying machine in FIG. 4 in explanation of its liquid developer squeezing operation.

FIG. 8 to FIG. 11 are the developed views of the surfaces of photoconductors in explanation of the modified dark areas and light areas formed on the surface of the photoconductors.

DETAILED DESCRIPTION OF THE PREFERRED EMBODIMENTS

Figure 1:
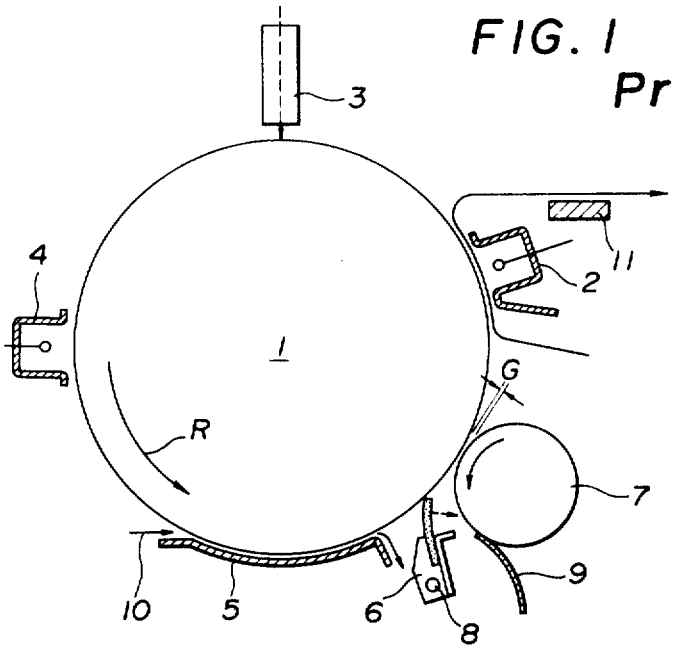
FIG. 1 Prior Art
FIG. 1 is a diagrammatical view of a conventional wet type electrophotographic copying machine.
Figure 2:
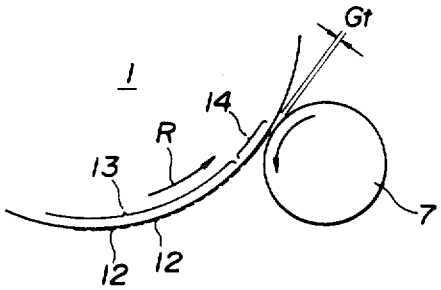
FIG. 2 is a diagrammatical view of the main portions of an embodiment of a wet type electrophotographic copying machine according to the present invention.
Figure 3:
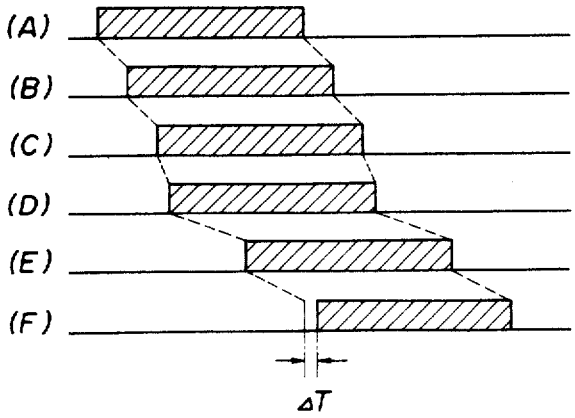
FIG. 3 is the timing chart of the operation of the wet type electrophotographic copying machine which is partly shown in FIG. 2.

Referring to FIG. 2 and FIG. 3, an embodiment of a wet type electrophotographic copying machine according to the present invention will now be described.

In FIG. 2, the gap G between a photoconductor drum 1 bearing no liquid developer and a squeegee roller 7 is determined in such a manner that there is no risk that the squeegee roller 7 comes into contact with the surface of the photoconductor drum 1. It is preferable that the gap G be in the range from about 20 μm to 100 μm, more preferably in the range from about 30 μm to 60 μm, in order to guarantee that the squeegee roller 7 does not come into contact with the surface of the photoconductor drum 1 even if there is some variation in accuracy of the positioning of the squeegee roller 7.

On the surface of the photoconductor drum 1, an image 12, which is to be transferred to a recording member, such as an image transfer sheet, is formed by predetermined charging, exposure and development. A liquid developer deposition portion 14 is formed on the downstream side of an image formation area 13 on the surface of the photoconductor drum 1. More specifically, the liquid developer deposition portion 14 is formed with the timing as shown in FIG. 3.

In FIG. 3, (A), designates a charge quenching process; (B), a cleaning process; (C), a charging process; (D), an exposure process; (E), a development process; and (F), an image transfer process. First, the surface of the photoconductor drum 1 is subjected to charge quenching by the charge quenching process (A) and cleaned by the cleaning process (B), and is then charged and exposed to a light image and an electrostatic latent image is developed, respectively, by the charging process (C), the exposure process (D) and the development process (E) with the timing prior to the formation of the image 12 to be transferred, whereby the liquid developer deposition portion 14 is formed. Therefore, the area of the liquid developer deposition portion 14 is determined by the difference in timing, ΔT, between the initiation of the charging, exposure and development and the formation of the image, and by the peripheral speed of the photoconductor drum 1. In the case where the photoconductor is in an endless shape, for example, in the shape of a drum, care must be taken for the liquid developer deposition portion 14 and the rear end of the image formation area 13 not to overlap.

Immediately before the liquid developer deposition portion 14, which is formed by the charging, exposure and development, comes to the position of the cleaning member 6, the cleaning member 6 has been detached from the surface of the photoconductor drum 1. When the liquid developer deposition portion 14 passes over the squeegee roller 7, the gap Gt between the squeegee roller 7 and the surface of the photoconductor drum 1 is substantially narrowed by the liquid developer deposition portion 14. The thickness of the liquid developer deposition portion 14 is in the range from about 5 μm to 20 μm. When the gap G between the photoconductor drum 1 and the squeegee roller 7 is set, for example, at 30 μm, and the thickness of the liquid developer deposition portion 14 is about 10 μm, the gap is reduced to about 20 μm (Gt) at the initiation of the squeezing by the squeegee roller 7 when the leading edge portion of the liquid developer deposition portion 14 passes over the squeegee roller 7. Thus, by the liquid developer deposition portion 14, the gap between the squeegee roller 7 and the surface of the photoconductor drum 1 is substantially decreased, so that the squeezing effect at the initiation of the squeezing can be significantly improved and the squeezing can be done sharply. In order to obtain such a sharp squeezing effect, it is preferable that the gap Gt be about 40 μm or less.

Referring to FIG. 4 to FIG. 8, there is partly shown another embodiment of a wet type electrophotographic copying machine according to the present invention.

Referring to FIG. 5, a pattern 18 for forming a dark area 16 and a light area 17 on the surface of the photoconductor drum 1 is formed on the upper surface of a transparent contact glass 15 by printing or other appropriate means as illustrated in FIG. 5. The position of the pattern 18 is limited to the area where an original 23 is not placed, on the downstream side with respect to the exposure scanning direction, more specifically to the end portion of the contact glass 15, which is covered with an original scale 19. Furthermore, the pattern 18 includes a high spectral sensitivity portion 20 on the downstream side with respect to the exposure scanning direction, for which the photoconductor drum 1 has a high spectral sensitivity, and a low spectral sensitivity portion 21 on the upstream side with respect to the exposure scanning direction, for which the photoconductor drum 1 has a low spectral sensitivity in comparison with for the high spectral sensitivity portion 20.

In this embodiment, the high sensitivity portion 20 is formed on the upper surface of the contact glass 15 by printing the same, for example, using a black ink, while the low spectral sensitivity portion 21 is formed by applying a duplex adhesive tape with a color of low spectral sensitivity for fixing the original scale 19 to the contact glass 15, for example, a white duplex adhesive tape, to one portion beside the high sensitivity portion 20 on the upper surface of the contact glass 15, without printing anything thereon.

The pattern 18 provided with the high spectral portion 20 and the low spectral portion 21 extends in the direction crossing the exposure scanning direction.

The dark area 16 and the light area 17 on the photoconductor drum 1, which are respectively formed by the high spectral sensitivity portion 20 and the low spectral sensitivity portion 21 of the pattern 18, are formed during the difference in timing, ΔT, between the initiation of the charging, exposure and development, and the initiation of the formation of the original image.

Referring to FIG. 6, under the condition that no liquid developer is deposited on the surface of the photoconductor drum 1, the gap G between the surface of the photoconductor drum 1 and the squeegee roller 7 is set in such a manner that there is no risk that the squeegee roller 7 comes into contact with the photoconductor drum 1, specifically, in the range from about 20 μm to 100 μm, more preferably in the range from about 30 μm to 60 μm.

The original 23 is placed on the contact glass 15, with one edge of the original 23 in conformity with the side edge 22 of the original scale 19 (refer to FIG. 5), and the original 23 is registered in accordance with the copy size line (not shown) printed on the original scale 19. Thus, the high spectral sensitivity portion 20, the low spectral sensitivity portion 21 and the original 23 are arranged in order in the exposure scanning direction and therefore, they are subjected to the exposure scanning in this order.

As the exposure scanning is performed, the electrostatic latent image corresponding to the pattern 18 and the original 23 are formed on the surface of the photoconductor drum 1 and those electrostatic latent images are developed to visible images.

Figure 7:
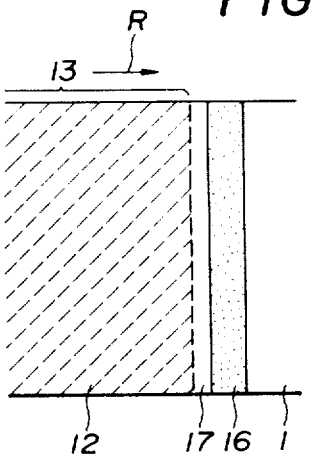
FIG. 7 is a developed view of the surface of the photoconductor of the wet type electrophotographic copying machine in FIG. 4 in explanation of the configuration of an image formation area, a dark area and a light area on the surface of the photoconductor.
Figure 8:
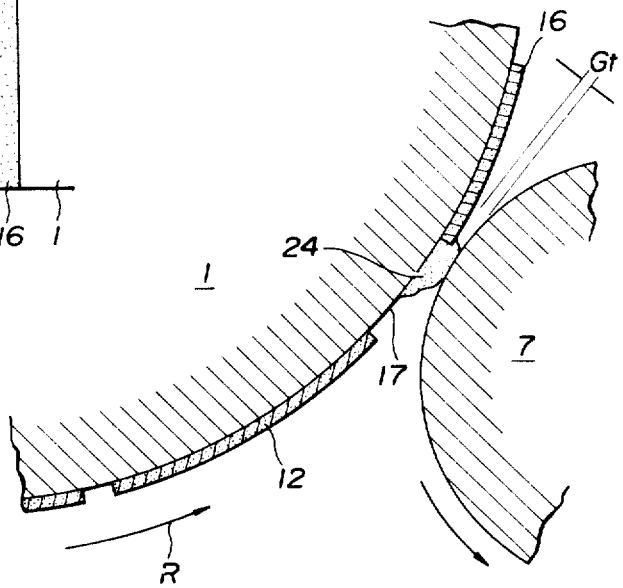

FIG. 6 to FIG. 8 show the process of that development. The image 12 corresponding to the original image, which is to be transferred to a recording material, for example, an image transfer sheet, is formed on the surface of the photoconductor drum 1. In the portion on the downstream side of the image formation area 13 in which the image 12 is formed, with respect to the movement of the photoconductor drum 1, there is formed the dark area 16, which constitutes the liquid developer deposition portion, corresponding to the high spectral sensitivity portion 20; and on the upstream side of the dark area 16, with respect to the movement of the photoconductor drum 1, there is formed the light area 17 in which no liquid developer is deposited, corresponding to the low spectral sensitivity portion 21 of the pattern 18, between the dark area 16 and the image formation area 13.

As shown in FIG. 7, the dark area 16 and the light area 17 extend across almost the full width of the photoconductor drum 1, that is, the full width of the effective photosensitive area on the photoconductor drum 1. The thickness of the dark area 16 is in the range from about 5 to 20 μm.

Immediately before the dark area 16 comes to the position of the cleaning member 6 with the rotation of the photoconductor drum 1, the cleaning member 6 is detached from the surface of the photoconductor drum 1. When the dark area 16 passes near the squeegee roller 7, the gap Gt between the photoconductor drum 1 and the squeegee roller 7 is apparently narrowed by the dark area 16, so that as in the case of the first embodiment, the squeezing effect at the squeezing initiation point becomes sharp and it does not occur that the liquid developer is locally deposited in quantity. It is preferable that the gap Gt be about 40 μm or less.

Until immediately before the dark area 16 passes over the cleaning member 6, the top edge of the cleaning member 6 is in elastic contact with the surface of the photoconductor drum 1, so that the coagulated developer adhering to the surface of the photoconductor drum 1 is collected by the leading edge portion of the cleaning member 6. When the leading edge portion of the cleaning member 6 is detached from the surface of the photoconductor drum 1, part of the coagulated developer adhering to and accumualted on the edge portion of the cleaning member 6 may adhere to the dark area 16. A lump of the coagulated developer 24 is stretched by the squeegee roller 7 in the upstream direction with respect to the rotation of the photoconductor drum 1, that is, in the direction of the image formation area 13. However, since the light area 17 bearing no developer thereon is present behind the dark area 16, the remainder of the lump of the coagulated developer 24 which has been stretched on the dark area 16 is collected to the light area 17.

When the dark area 16 continuously extends up to the leading edge of the image formation area 13 and the lump of the coagulated developer 24 adheres to the dark area 16, the lump of the coagulated developer 24 is drawn backwards by the squeegee roller 7 and enters the image formation area 13. As a result, the recording material is smeared by the lump of the coagulated developer 24.

In this embodiment, since the light area 17 with less developer deposition in comparison with the dark area 16 is disposed behind the dark area 16 (particularly in this embodiment, almost no developer is deposited in the light area 17), if the lump of coagulated developer 24 adheres to the dark area 16 and is stretched, the lump of coagulated developer 24 is collected by the light area 17, so that the intrusion of such coagulated developer into the image formation area 13 is prevented.

Figure 9:
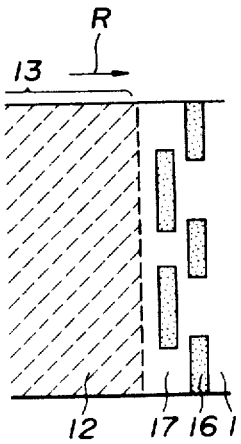
Figure 10:
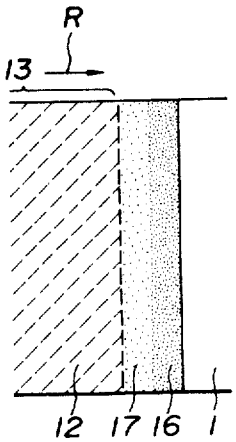
Figure 11:
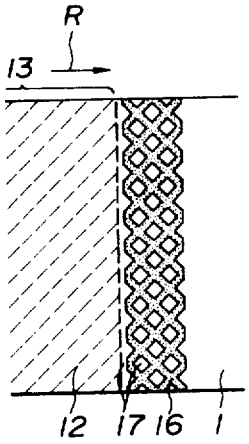

Referring to FIG. 9 to FIG. 11, there are shown modifications of the dark area and the light area formed the surface of the photoconductor drum 1.

In the modification shown in FIG. 9, the dark area 16 is not formed continuously in the direction of the width of the photoconductor drum 1, but it is separated in a plurality of portions which are shifted to each other in the movement direction in such a manner as to overlap each other when viewed from the movement direction of the photoconductor.

In the modification shown in FIG. 10, the dark area 16 and the light area 17 are continuously formed in the direction of the width of the photoconductor drum 1, so that a small amount of the liquid developer is deposited on the light area 17 as well.

In the modification shown in FIG. 11, the dark area 16 is formed net-like and extends almost across the full width of the photoconductor drum 1. Therefore, the dark area 16 and the light area 17 are formed alternately in the movement direction of the photoconductor drum 1.

The pattern 18 forming the dark area 16 and the light area 17 on the surface of the photoconductor drum 1 can be formed by coloring the lower surface of the original scale 19 or the lower surface of the contact glass 15 so as to form the high spectral sensitivity portion 20 and the low spectral sensitivity portion 21, instead of forming the pattern 18 on the upper surface of the contact glass as shown in FIG. 5.

When the pattern 18 is formed between the contact glass 15 and the original scale 18 or on the lower surface of the contact glass 15, the pattern 18 will not be scratched or damaged when cleaning the contact glass 15. In particular, when the pattern 18 is disposed between the lower surface of the original scale 19 and the upper surface of the contact glass 15, the pattern 18 and the surface of an original placed on the contact glass 15 are on the same plane. Therefore, the dark area 16 and the light area 17 can be accurately formed on the surface of the photoconductor even when an optical system with a small depth of focus is employed.

According to the present invention, even if the gap between the photoconductor and an excess developer elimination member for eliminating excess developer from the surface of the photoconductor, such as a squeegee roller, is set in such a manner that there is no risk that the image density is lowered or the excess developer elimination member comes into contact with the photoconductor, excellent squeezing effect can be obtained from the initiation of squeezing, whereby the deposition of excess developer to the recording material can be prevented and the copying performance can be improved.

What is claimed is:

1. In a wet type electrophotographic copying machine capable of performing one copy making process during substantially two revolutions of a photoconductor, which comprises a development section for applying a liquid developer to the surface of a photoconductor which bears an electrostatic latent image, said development section disposed in proximity to the peripheral surface of said photoconductor, along the movement direction of said photoconductor; a cleaning member which is disposed detachably from the surface of said photoconductor on which an electrostatic latent image is formed; and an excess liquid developer elimination member for eliminating the excess developer from the surface of said photoconductor, said excess liquid developer elimination member disposed in proximity to said photoconductor with a small gap therebetween, the improvement comprising means for forming a liquid developer deposition portion by charging and development on the downstream side of an image formation area on said photoconductor, with respect to the movement direction of said photoconductor, in said image formation area in which an image to be transferred to an image transfer material is formed, said liquid developer deposition portion capable of substantially narrowing the gap between said photoconductor and said excess liquid developer elimination member.

2. A wet type electrophotographic copying machine as claimed in claim 1, wherein the gap between said photoconductor and said excess liquid developer elimination member is in the range of about 20 μm to 100 μm, and the thickness of said liquid developer deposition portion is in the range of about 5 μm to 20 μm.

3. A wet type electrophotographic copying machine as claimed in claim 1, wherein the gap between said excess liquid developer elimination member and said liquid developer deposition portion is about 40 μm or less.

4. In a wet type electrophotographic copying machine capable of performing one copy making process during substantially two revolutions of a photoconductor, which comprises a development section for applying a liquid developer to the surface of a photoconductor which bears an electrostatic latent image, said development section disposed in proximity to the peripheral surface of said photoconductor, along the movement direction of said photoconductor; a cleaning member which is disposed detachably from the surface of said photoconductor on which an electrostatic latent image is formed; and an excess liquid developer elimination member for eliminating the excess developer from the surface of said photoconductor, said excess liquid developer elimination member disposed in proximity to said photoconductor with a small gap therebetween, the improvement comprising means for forming a dark area constituting a liquid developer deposition portion by charging and development on the downstream side of an image formation area on said photoconductor, with respect to the movement direction of said photoconductor, in said image formation area in which an image to be transferred to an image transfer material is formed, said dark area capable of substantially narrowing the gap between said photoconductor and said excess liquid developer elimination member; and a light area formed on the upstream side of said dark area on said photoconductor with respect to the movement direction of said photoconductor, said light area bearing litte or no developer in contrast to said dark area.

5. A wet type electrophotographic copying machine as claimed in claim 4, wherein said means for forming said dark area and said light area on said photoconductor comprises:

a pattern which is disposed between a contact glass for placing an original thereon, and an original scale, said pattern including a high spectral sensitivity portion for which said photoconductor has a high spectral sensitivity, and a low spectral sensitivity portion for which said photoconductor has a low spectral sensitivity, said low spectral sensitivity portion disposed upstream of said high spectral sensitivity portion with respect to an exposure scanning direction;

an exposure apparatus for scanning the surface of said pattern and projecting the light reflected from the surface of said pattern onto the surface of said photoconductor; and a developer for developing electrostatic latent images formed corresponding to the images of said pattern to visible images.

6. A wet type electrophotographic copying machine as claimed in claim 5, wherein said high spectral sensitivity portion of said pattern is printed on the upper surface of said contact glass, and said low spectral sensitivity portion is made of a duplex adhesive tape with a color for which said photoconductor has a low spectral sensitivity, said duplex adhesive tape serving for fixing said original scale to said contact glass.

7. A wet type electrophotographic copying machine as claimed in claim 4, wherein said dark area and said light area are formed across substantially the entire width of the effective photosensitive area on said photoconductor.

8. A wet type electrophotographic copying machine as claimed in claim 4, wherein the gap between said photoconductor and said excess liquid developer elimination member is in the range of about 20 μm to 100 μm and the thickness of said dark area is in the range from about 5 μm to 20 μm.

* * * * *